US011655569B2

(12) United States Patent
Rodriguez Camelo et al.

(10) Patent No.: US 11,655,569 B2
(45) Date of Patent: May 23, 2023

(54) HEAT-SHRINKABLE WOVEN RAFFIA FABRIC, AND METHODS THEREOF

(71) Applicants: Dow Global Technologies LLC, Midland, MI (US); Dow Quimica De Colombia S.A., Bogota (CO); PBBPolisur S.R.L., Buenos Aires (AR)

(72) Inventors: Jorge Mario Rodriguez Camelo, Bogota (CO); Jorge Caminero Gomes, Sao Paulo (BR); Camila Do Valle, Paulo (BR); Maximiliano Zanetti, Buenos Aires (AR); Marlos Giuntini De Oliveria, Sao Paulo (BR)

(73) Assignee: Dow Global Technologies LLC, Midland, MI (US)

( * ) Notice: Subject to any disclaimer, the term of this patent is extended or adjusted under 35 U.S.C. 154(b) by 91 days.

(21) Appl. No.: 17/056,097

(22) PCT Filed: Jul. 11, 2019

(86) PCT No.: PCT/US2019/041282
§ 371 (c)(1),
(2) Date: Nov. 17, 2020

(87) PCT Pub. No.: WO2020/023215
PCT Pub. Date: Jan. 30, 2020

(65) Prior Publication Data

US 2021/0207298 A1 Jul. 8, 2021

Related U.S. Application Data

(60) Provisional application No. 62/703,726, filed on Jul. 26, 2018.

(51) Int. Cl.

| | |
|---|---|
| ***D03D 15/46*** | (2021.01) |
| ***D03D 15/283*** | (2021.01) |
| ***D03D 15/217*** | (2021.01) |
| ***D02G 3/36*** | (2006.01) |

(52) U.S. Cl.
CPC ..... *D03D 15/46* (2021.01); *D02G 3/36* (2013.01); *D03D 15/217* (2021.01); *D03D 15/283* (2021.01); *D10B 2201/01* (2013.01); *D10B 2321/021* (2013.01); *D10B 2321/022* (2013.01); *D10B 2401/04* (2013.01)

(58) Field of Classification Search
CPC .... D03D 15/46; D03D 15/217; D03D 15/283; D03D 1/00; D02G 3/36; D10B 2201/01; D10B 2321/02; D10B 2321/021; D10B 2401/04; B65D 71/08
See application file for complete search history.

(56) References Cited

U.S. PATENT DOCUMENTS

| | | | |
|---|---|---|---|
| 4,554,202 | A | 11/1985 | Kamei et al. |
| 5,712,008 | A | 1/1998 | Todt |
| 2007/0178303 | A1 | 8/2007 | Maziers et al. |
| 2018/0298524 | A1 | 10/2018 | Llop et al. |

FOREIGN PATENT DOCUMENTS

| | | |
|---|---|---|
| JP | 60052648 | 3/1985 |
| JP | S6426754 | 1/1989 |
| JP | 3228706 | 11/2001 |
| JP | 2005329979 | 12/2005 |

OTHER PUBLICATIONS

PCT/US2019/041282, International Search Report and Written Opinion dated Oct. 23, 2019.
PCT/US2019/041282, International Preliminary Report on Patentability dated Jan. 26, 2021.

*Primary Examiner* — Arti Singh-Pandey

(57) ABSTRACT

A method for shrink wrapping two or more articles, the method comprising: providing a heat shrinkable woven raffia fabric formed from warp and weft tapes, the warp and weft tapes comprising at least 70 wt. %, based on the total wt. % of polymers present in the warp and weft tapes, of an ethylene/alpha-olefin copolymer having a density of 0.945 g/cc or greater and a melt index (I2), as determined according to ASTM D1238 (190° C., 2.16 kg), of from 0.01 to 2.0 g/10 min; wrapping the heat shrinkable woven raffia fabric around two or more articles to form a wrapped bundle; and heating the wrapped bundle to form a shrink wrapped bundle.

12 Claims, No Drawings

HEAT-SHRINKABLE WOVEN RAFFIA FABRIC, AND METHODS THEREOF

FIELD

Embodiments of the present disclosure generally relate to polyethylene-based heat shrinkable woven fabric, and methods of using polyethylene-based heat shrinkable woven fabric.

BACKGROUND

Shrink packaging generally involves wrapping an article(s) in a shrink film to form a package, and then heat shrinking the film by exposing it to sufficient heat to cause shrinkage and intimate contact between the film and article. However, for unitization packaging, where heavier articles (e.g., a plurality of boxes, cartons, packages, pails, etc.) are packaged together in one load for ease of handling, identification, and transportation, shrink films are not typically used. Instead, corrugated cardboards are often used as it can provide cushioning and structural strength. Corrugated cardboards are not without its disadvantages. Corrugated cardboard can have relatively low resistance to mechanical stress, lack waterproofing, and be quite bulky.

Accordingly, it is desirable to have alternative unitization and/or heavy duty packaging options.

SUMMARY

Disclosed in embodiments herein are heat shrinkable woven raffia fabric. The heat shrinkable woven raffia fabric is formed from warp and weft tapes, wherein the warp and weft tapes comprise at least 70 wt. % of an ethylene/alpha-olefin copolymer having a density greater than 0.945 g/cc and a melt index ($I_2$) of from 0.01 to 2.0 g/10 minutes.

Also disclosed in embodiments herein are methods of shrink wrapping two or more articles. The methods comprise providing a heat shrinkable woven raffia fabric formed from warp and weft tapes, the warp and weft tapes comprising at least 70 wt. % of an ethylene/alpha-olefin copolymer having a density greater than 0.945 g/cc and a melt index ($I_2$) of from 0.01 to 2.0 g/10 minutes; wrapping the heat shrinkable woven raffia fabric around two or more articles to form a wrapped bundle; and heating the wrapped bundle to form a shrink wrapped bundle.

In an embodiment, the heat shrinkable woven raffia fabric, according to any of the preceding embodiments, is coated with a polyolefin resin. The polyolefin resin may comprise a low density polyethylene, a linear low density polyethylene, polypropylene, or a blend of two or more of the low density polyethylene, the linear low density polyethylene, or the polypropylene. In some embodiments, the polyolefin resin comprises low density polyethylene.

In an embodiment, the ethylene/alpha-olefin copolymer, according to any of the preceding embodiments, has a density of from 0.945 to 0.960 g/cc. In an embodiment, the ethylene/alpha-olefin copolymer, according to any of the preceding embodiments, has a melt index (I2), as determined according to ASTMD1238 (190° C., 2.16 kg) of 0.1 to 1.5 g/10 min. In an embodiment, the ethylene/alpha-olefin copolymer, according to any of the preceding embodiments, has a melt flow ratio (I10/I2) of 7.1 to 30.0. In an embodiment, the ethylene/alpha-olefin copolymer, according to any of the preceding embodiments, has Vicat softening temperature of from 100° C. to 140° C. In an embodiment, the ethylene/alpha-olefin copolymer, according to any of the preceding embodiments, has ratio of weight average molecular weight (Mw) to number average molecular weight (Mn) (Mw/Mn) of from 3.0 to 6.0.

In an embodiment, the warp and weft tapes, according to any of the preceding embodiments, further comprise less than or equal to 10 wt. % of one or more resins selected from the group consisting of a low density polyethylene having a density of about 0.916 g/cm$^3$ to about 0.929 g/cm$^3$, a medium density polyethylene having a density of about 0.930 g/cm$^3$ to about 0.945 g/cm$^3$, a high density polyethylene having a density of about 0.945 g/cm$^3$ to about 0.970 g/cm$^3$, a linear low density polyethylene having a density of about 0.916 g/cm$^3$ to about 0.929 g/cm$^3$, and a very low density polyethylene having a density of 0.860 g/cm$^3$ to about 0.912 g/cm$^3$.

In an embodiment, the wrapped bundle, according to any of the preceding embodiments, is heated such that the heat shrinkable woven raffia fabric reaches a temperature of from 100° C. to 165° C.

In an embodiment, when the wrapped bundle is heated, according to any of the preceding embodiments, the heat shrinkable woven raffia fabric has a warp direction free shrinkage at 130° C. of from 5% to 90% and a weft direction free shrinkage at 130° C. of from 5% to 90%, both as measured by ASTM D2732 test method.

Additional features and advantages of the embodiments will be set forth in the detailed description which follows, and in part will be readily apparent to those skilled in the art from that description or recognized by practicing the embodiments described herein, including the detailed description and the claims. It is to be understood that both the foregoing and the following description describe various embodiments and are intended to provide an overview or framework for understanding the nature and character of the claimed subject matter.

DETAILED DESCRIPTION

Reference will now be made in detail to embodiments of heat shrinkable woven raffia fabric, and methods thereof. The heat shrinkable woven raffia fabric may be used in the packaging of multiple heavier articles. It is noted, however, that this is merely an illustrative implementation of the embodiments disclosed herein. The embodiments are applicable to other technologies that are susceptible to similar problems as those discussed above. For example, the heat shrinkable woven raffia fabric described herein may be used in other heavy duty packaging applications, such as, heavy duty shipping sacks, woven bags, or other general purpose bags, etc., all of which are within the purview of the present embodiments.

In embodiments herein, the heat shrinkable woven raffia fabric is formed from warp and weft tapes. The warp and weft tapes are interlaced such that the warp tapes run lengthwise in the woven raffia fabric, while the weft tapes run perpendicular to the warp tapes. The term tapes may be used interchangeably with the terms filaments, yarns, or fibers, all of which may be suitably used to form a heat shrinkable woven raffia fabric.

Each warp or weft tape may have a titer of 300 DEN to 4,000 DEN. All individual values and subranges of 300 DEN to 4,000 DEN are included and disclosed herein. For example, in some embodiments, the each warp or weft tape may have a titer ranging from 300 DEN to 3,000 DEN, 400 DEN to 3,000 DEN, 400 DEN to 2,000 DEN, 500 DEN to 2,000 DEN or from 550 DEN to 1,500 DEN. As used herein, "DEN" refers to denier, which is the linear mass density of a warp or weft tape. Denier or DEN is expressed as the weight of a warp or weft tape in grams per 9,000 meters (g/9,000 m) of the warp or weft tape.

The warp and weft tapes comprise at least 70 wt. %, based on the total polymer weight in a tape, of an ethylene/α-olefin copolymer. All individual values and subranges described above are included and disclosed herein. For example, in some embodiments, each warp and weft tape may comprise 70 to 100 wt. %, 80 wt. % to 100 wt. %, 85 wt. % to 100 wt. %, 90 to 100 wt. %, 90 to 99 wt. %, 90 to 97.5 wt. %, or 90 to 95 wt. % of the ethylene/α-olefin copolymer.

Ethylene/α-Olefin Copolymer

The ethylene/α-olefin copolymer comprises (a) from 70 to 99.5 percent, for example, from 75 to 99.5 percent, from 80 to 99.5 percent, from 85 to 99.5 percent, from 90 to 99.5 percent, or from 92 to 99.5 percent, by weight of the units derived from ethylene; and (b) from 0.5 to 30 percent, for example, from 0.5 to 25 percent, from 0.5 to 20 percent, from 0.5 to 15 percent, from 0.5 to 10 percent, or from 0.5 to 8 percent, by weight of units derived from one or more α-olefin comonomers. The comonomer content may be measured using any suitable technique, such as techniques based on nuclear magnetic resonance ("NMR") spectroscopy, and, for example, by $^{13}C$ NMR analysis as described in U.S. Pat. No. 7,498,282, which is incorporated herein by reference The α-olefin comonomers have no more than 20 carbon atoms. For example, the α-olefin comonomers may have 3 to 10 carbon atoms, or 3 to 8 carbon atoms. Exemplary α-olefin comonomers include, but are not limited to, propylene, 1-butene, 1-pentene, 1-hexene, 1-heptene, 1-octene, 1-nonene, 1-decene, and 4-methyl-1-pentene. The one or more α-olefin comonomers may, for example, be selected from the group consisting of propylene, 1-butene, 1-hexene, and 1-octene; or in the alternative, from the group consisting of 1-hexene and 1-octene.

In embodiments herein, the ethylene/α-olefin copolymer has a density of 0.945 g/cc or greater. All individual values and subranges 0.945 g/cc or greater are included and disclosed herein. For example, in some embodiments, the ethylene/α-olefin copolymer has a density from a lower limit of 0.945, or 0.948 g/cc to an upper limit of 0.965, 0.960, 0.958, 0.955, or 0.953 g/cc. In other embodiments, the ethylene/α-olefin copolymer has a density of from 0.945 to 0.965 g/cc, 0.945 to 0.960 g/cc, from 0.945 to 0.958 g/cc, from 0.948 to 0.958 g/cc, or from 0.948 to 0.953 g/cc.

In addition to the density, the ethylene/α-olefin copolymer has a melt index ($I_2$), as determined according to ASTM D1238 (190° C., 2.16 kg), of from 0.01 to 2 g/10 minutes. All individual values and subranges from 0.01 to 2 g/10 minutes are included and disclosed herein. For example, in some embodiments, the ethylene/α-olefin copolymer has a melt index ($I_2$) ranging from a lower limit of 0.01, 0.05, 0.1, 0.2, 0.5, or 0.7 g/10 minutes to an upper limit of 1.1, 1.5, or 1.8 g/10 minutes. In other embodiments, the ethylene/α-olefin copolymer has a melt index ($I_2$), as determined according to ASTM D1238 (190° C., 2.16 kg), of from 0.1 to 1.5 g/10 minutes, from 0.5 to 1.5 g/10 minutes, from 0.5 to 1.1 g/10 minutes, or from 0.7 to 1.1 g/10 minutes.

In addition to the density and melt index (I2), the ethylene/α-olefin copolymer may have a melt index ratio, I10/I2, of from 7.1 to 30.0. All individual values and subranges of from 7.1 to 30.0 are included and disclosed herein. For example, the ethylene/α-olefin copolymer may have a melt index ratio, I10/I2, of from 7.1 to 10, from 7.1 to 9.0, or from 7.1 to 7.9. I10 is determined according to ASTM D1238 (190° C., 10.0 kg).

In addition to the density, melt index (I2), and melt index ratio (I10/I2), the ethylene/α-olefin copolymer may have a Vicat softening temperature of from 100° C. to 140° C. All individual values and subranges of from 100° C. to 140° C. are included and disclosed herein. For example, the ethylene/α-olefin copolymer may have a Vicat softening temperature of from 100° C. to 130° C., from 110° C. to 130° C., from 115° C. to 125° C., or from 118° C. to 122° C. The Vicat softening temperature may be determined according to ASTM D1525.

In addition to the density, melt index (I2), melt index ratio (I10/I2), and Vicat softening temperature, the ethylene/α-olefin copolymer may have a molecular weight distribution (Mw/Mn) from 3.0 to 6.0, where Mw is the weight average molecular weight (Mw) and Mn is the number average molecular weight. All individual values and subranges of from 3.0 to 6.0 are included and disclosed herein. For example, the ethylene/α-olefin copolymer may have a molecular weight distribution (Mw/Mn) from 3.2 to 5.5, from 3.5 to 5.5, from 3.5 to 5.0, from 4.0 to 5.0, or from 4.2 to 4.6. The molecular weights may be measured using conventional gel permeation chromatography (GPC).

Any conventional ethylene (co)polymerization reaction processes may be employed to produce the ethylene/α-olefin copolymer. Such conventional ethylene (co)polymerization reaction processes include, but are not limited to, gas phase polymerization process, slurry phase polymerization process, solution phase polymerization process, and combinations thereof using one or more conventional reactors, e.g. fluidized bed gas phase reactors, loop reactors, stirred tank reactors, batch reactors in parallel, series, and/or any combinations thereof. Examples of suitable polymerization processes are described in U.S. Pat. No. 6,982,311, 6,486,284, 8,829,115 or 8,327,931, which are incorporated herein by reference.

In embodiments described herein the warp and weft tapes may further comprise up to 30 wt. %, alternatively, up to 20 wt. % or up to 10 wt. %, of optional polymers. Examples of optional polymers include low density polyethylene, medium density polyethylene, high density polyethylene, linear low density polyethylene, or very low density polyethylene. In some embodiments, the warp and weft tapes may further comprise up to 30 wt. % of one or more resins selected from the group consisting of a low density polyethylene having a density of about 0.916 g/cm$^3$ to about 0.929 g/cm$^3$, a medium density polyethylene having a density of about 0.930 g/cm$^3$ to about 0.945 g/cm$^3$, a high density polyethylene having a density of about 0.945 g/cm$^3$ to about 0.970 g/cm$^3$, a linear low density polyethylene having a density of about 0.916 g/cm$^3$ to about 0.929 g/cm$^3$, and a very low density polyethylene having a density of 0.860 g/cm$^3$ to about 0.912 g/cm$^3$.

In embodiments described herein the warp and weft tapes may further comprise optional additives. Exemplary additives may include, but are not limited to, antistatic agents, color enhancers, dyes, lubricants, fillers such as $TiO_2$ or $CaCO_3$, opacifiers, nucleators, processing aids, pigments, primary antioxidants, secondary antioxidants, processing aids, UV stabilizers, anti-blocks, slip agents, tackifiers, fire retardants, anti-microbial agents, odor reducer agents, anti-fungal agents, and combinations thereof. The warp and weft tapes may contain up to 30 wt. % alternatively, up to 20 wt. % or up to 10 wt. %, by the combined weight of such additives, based on the total weight of materials present in the warp and weft tapes.

Coating

The heat shrinkable woven raffia fabric, according to any of the embodiments described herein, may be further coated with a polyolefin resin. In embodiments herein, the heat shrinkable woven raffia fabric is coated with 100 wt. % of a polyolefin resin, based on the total weight of polymers present in the coating. The polyolefin resin comprises a low density polyethylene, a linear low density polyethylene, polypropylene, or a blend of two or more of the low density polyethylene, the linear low density polyethylene, or the polypropylene. In some embodiments, the polyolefin resin comprises low density polyethylene, wherein the heat shrinkable woven raffia fabric is coated with 100 wt. % of the low density polyethylene, based on the total weight of polymers present in the coating.

Exemplary additives that may be present in the coating may include, but are not limited to, antistatic agents, color enhancers, dyes, lubricants, fillers such as $TiO_2$ or $CaCO_3$, opacifiers, nucleators, processing aids, pigments, primary antioxidants, secondary antioxidants, processing aids, UV stabilizers, anti-blocks, slip agents, tackifiers, fire retardants, anti-microbial agents, odor reducer agents, antifungal agents, and combinations thereof. The coating may contain from about 0.1 to about 30 percent, alternatively, from about 0.1 to about 20 wt. % or from about 0.1 to about 10 wt. %, by the combined weight of such additives, based on the total weight of materials present in the coating.

Methods

In embodiments herein, disclosed is a method for shrink wrapping two or more articles. The method comprises providing a heat shrinkable woven raffia fabric according to any of the embodiments described herein; wrapping the heat shrinkable woven raffia fabric around two or more articles to form a wrapped bundle; and heating the wrapped bundle to form a shrink wrapped bundle. In some embodiments, the wrapped bundle is heated such that the heat shrinkable woven raffia fabric reaches a temperature of from 100° C. to 165° C.

When the wrapped bundle is heated, the heat shrinkable woven raffia fabric may have a warp direction free shrinkage at 130° C. of from 5% to 90% and a weft direction free shrinkage at 130° C. of from 5% to 90%, both as measured by ASTM D2732 test method. In some embodiments, the heat shrinkable woven raffia fabric may have a warp direction free shrinkage at 130° C. of from 10% to 80% and a weft direction free shrinkage at 130° C. of from 10% to 80%, both as measured by ASTM D2732 test method. The free shrinkage may be individually varied in the warp direction versus the weft direction by varying the draw ratio during the tape orientation step. For example, in some embodiments, the heat shrinkable woven raffia fabric may have a warp direction free shrinkage at 130° C. of from 60% to 90% and a weft direction free shrinkage at 130° C. of from 5% to 25%, both as measured by ASTM D2732 test method.

The heat shrinkable woven raffia fabric described herein can be made by any suitable raffia fabrication process. In one exemplary embodiment, the raffia process includes the following main steps involved in the production of tapes are: extrusion of film, quenching of film, slitting of film into tapes, orientation of tapes, annealing of tapes, winding, weaving, and finishing.

Test Methods

Unless otherwise stated, the following test methods are used.

Density

Density can be measured in accordance with ASTM D-792.

Melt Index

Melt index ($I_2$) can be measured in accordance with ASTM D-1238, Procedure B (condition 190° C./2.16 kg). Melt index ($I_{10}$) can be measured in accordance with ASTM D-1238, Procedure B (condition 190° C./10.0 kg).

Vicat Softening Point

Vicat softening point may be measured in accordance with ASTM D-1525.

Gel Permeation Chromatography (GPC)

The chromatographic system consisted of a PolymerChar GPC-IR (Valencia, Spain) high temperature GPC chromatograph equipped with an internal IR5 detector. The autosampler oven compartment was set at 160° Celsius and the column compartment was set at 150° Celsius. The columns used were 3 Agilent "Mixed B" 30 cm 10-micron linear mixed-bed columns and a 10-um pre-column. The chromatographic solvent used was 1,2,4 trichlorobenzene and contained 200 ppm of butylated hydroxytoluene (BHT). The solvent source was nitrogen sparged. The injection volume used was 200 microliters and the flow rate was 1.0 milliliters/minute.

Calibration of the GPC column set was performed with 21 narrow molecular weight distribution polystyrene standards with molecular weights ranging from 580 to 8,400,000 and were arranged in 6 "cocktail" mixtures with at least a decade of separation between individual molecular weights. The standards were purchased from Agilent Technologies. The polystyrene standards were prepared at 0.025 grams in 50 milliliters of solvent for molecular weights equal to or greater than 1,000,000, and 0.05 grams in 50 milliliters of solvent for molecular weights less than 1,000,000. The polystyrene standards were dissolved at 80 degrees Celsius with gentle agitation for 30 minutes. The polystyrene standard peak molecular weights were converted to polyethylene molecular weights using Equation 1 (as described in Williams and Ward, J. Polym. Sci., Polym. Let., 6, 621 (1968)):

$$M_{polyethylene}=A\times(M_{polystyrene})^{B} \quad \text{(EQ 1)}$$

where M is the molecular weight, A has a value of 0.4315 and B is equal to 1.0.

A fifth order polynomial was used to fit the respective polyethylene-equivalent calibration points. A small adjustment to A (from approximately 0.415 to 0.44) was made to correct for column resolution and band-broadening effects such that NIST standard NBS 1475 is obtained at 52,000 Mw.

The total plate count of the GPC column set was performed with Eicosane (prepared at 0.04 g in 50 milliliters of TCB and dissolved for 20 minutes with gentle agitation.) The plate count (Equation 2) and symmetry (Equation 3) were measured on a 200 microliter injection according to the following equations:

$$\text{Plate Count} = 5.54 * \left(\frac{RV_{Peak\,Max}}{\text{Peak Width at } \frac{1}{2} \text{ height}}\right)^2 \quad \text{(EQ2)}$$

where RV is the retention volume in milliliters, the peak width is in milliliters, the peak max is the maximum height of the peak, and ½ height is ½ height of the peak maximum.

$$\text{Symmetry} = \frac{(\text{Rear Peak } RV_{one\,tenth\,height} - RV_{Peak\,max})}{(RV_{Peak\,max} - \text{Front Peak } RV_{one\,tenth\,height})} \quad \text{(EQ3)}$$

where RV is the retention volume in milliliters and the peak width is in milliliters, Peak max is the maximum position of the peak, one tenth height is 1/10 height of the peak maximum, rear peak refers to the peak tail at later retention volumes than the peak max, and front peak refers to the peak front at earlier retention volumes than the peak max. The plate count for the chromatographic system should be greater than 24,000 and symmetry should be between 0.98 and 1.22.

Samples were prepared in a semi-automatic manner with the PolymerChar "Instrument Control" Software, wherein the samples were weight-targeted at 2 mg/ml, and the solvent (contained 200 ppm BHT) was added to a pre-nitrogen-sparged septa-capped vial, via the PolymerChar high temperature autosampler. The samples were dissolved for 2 hours at 160° Celsius under "low speed" shaking.

The calculations of Mn, Mw, and Mz were based on GPC results using the internal IR5 detector (measurement channel) of the PolymerChar GPC-IR chromatograph according to Equations 4-6, using PolymerChar GPCOne™ software, the baseline-subtracted IR chromatogram at each equally-spaced data collection point (i), and the polyethylene equivalent molecular weight obtained from the narrow standard calibration curve for the point (i) from Equation 1.

$$M_n = \frac{\sum^{i} IR_i}{\sum^{i} \left(IR_i / M_{polyethylene_i}\right)} \quad \text{(EQ4)}$$

$$M_w = \frac{\sum^{i} \left(IR_i * M_{polyethylene_i}\right)}{\sum^{i} IR_i} \quad \text{(EQ5)}$$

$$M_z = \frac{\sum^{i} \left(IR_i * M^2_{polyethylene_i}\right)}{\sum^{i} \left(IR_i * M_{polyethylene_i}\right)} \quad \text{(EQ6)}$$

In order to monitor the deviations over time, a flowrate marker (decane) was introduced into each sample via a micropump controlled with the PolymerChar GPC-IR system. This flowrate marker was used to linearly correct the flowrate for each sample by alignment of the respective decane peak within the sample to that of the decane peak within the narrow standards calibration. Any changes in the time of the decane marker peak are then assumed to be related to a linear shift in both flowrate and chromatographic slope. To facilitate the highest accuracy of a RV measurement of the flow marker peak, a least-squares fitting routine is used to fit the peak of the flow marker concentration chromatogram to a quadratic equation. The first derivative of the quadratic equation is then used to solve for the true peak position. After calibrating the system based on a flow marker peak, the effective flowrate (as a measurement of the calibration slope) is calculated as Equation 7. Processing of the flow marker peak was done via the PolymerChar GPCOne™ Software.

$$\text{Flowrate}_{effective} = \text{Flowrate}_{nominal} \times \frac{FlowMarker_{Calibration}}{FlowMarker_{Observed}} \quad \text{(EQ7)}$$

Free Shrinkage

A 100 mm×100 mm test specimen is immersed in oil at the temperatures outlined in Table 5 for a period of 10 seconds. The test specimens are then removed and quickly plunged into a fluid bath at ambient conditions (23° C., 1 atm, 50% relative humidity) for 5 seconds for cooling. The free shrinkage is measured on the test specimen in the warp direction and weft direction according to ASTM D-2732.

Dart Drop Impact

The dart drop impact is measured according to ASTM D1709, Method A using a stainless steel dart having a 38.1 mm diameter, at a drop height of 0.66 m (26 in.) using a sample having a width of 41 cm (16 in.), depth of 41 cm (16 in.), and a height of 120 cm (47 in.). Measurements are made at (1) ambient conditions (23° C., 1 atm, 50% relative humidity) and (2) in a controlled environment for 2 weeks at 93% relative humidity, 23° C., and 1 atm. The maximum obtainable value using the Method A test is 900 grams. Greater than 900 grams is achieved when the sample does not fail.

The dart drop impact is also measured according to ASTM D1709, Method B using a stainless steel dart having a 50.8 mm diameter, at a drop height of 1.524 m (60 in.) using a sample having a width of 41 cm (16 in.), depth of 41 cm (16 in.), and a height of 206 cm (81 in.). Measurements are made at (1) ambient conditions (23° C., 1 atm, 50% relative humidity) and (2) in a controlled environment for 2 weeks at 93% relative humidity, 23° C., and 1 atm.

Elmendorf Tear

Elmendorf tear is measured according to ASTM D1922 in the warp and weft direction. Measurements are made at (1) ambient conditions (23° C., 1 atm, 50% relative humidity), (2) in a controlled environment for 48 hours at 93% relative humidity, 23° C., and 1 atm, and (3) in a controlled environment for 2 weeks at 93% relative humidity, 23° C., and 1 atm.

EXAMPLES

The resins used in the examples are shown below in Table 1. All resins are commercially available from The Dow Chemical Company (Midland, Mich.).

TABLE 1

| | Resins | | | |
|---|---|---|---|---|
| | DOWLEX ™ 2045.11 | DOWLEX ™ 2050B | LDPE 722 | LDPE 132i |
| Description | Ethylene/ alpha-olefin copolymer | Ethylene/ alpha-olefin copolymer | Low density polyethylene | Low density polyethylene |
| Density (g/cc) | 0.922 | 0.950 | 0.918 | 0.921 |
| Melt Index, 12 (g/10 min) | 1.0 | 0.95 | 8.0 | 0.25 |
| I10/I2 | | 7.5 | | |
| Mw (g/mole) | | 122,500 | | |
| Mn (g/mole) | | 27,600 | | |
| Mw/Mn (MWD) | | 4.4 | | |
| Vicat Softening Point (° C.) | | 120 | | |

Inventive Example 1 ("Inv. 1")—Tapes were made from 100 wt. % of DOWLEX™ 2050B having a denier of 820 and a width of 3.0 mm. The tapes were fabricated using a Starlinger Starex 1500ES tape extrusion line under the process conditions shown in Table 2.

TABLE 2

| Tape Process Conditions | |
|---|---|
| Zone 1 (° C.) | 250 |
| Zone 2 (° C.) | 250 |
| Zone 3 (° C.) | 250 |
| Zone 4 (° C.) | 250 |
| Zone 5 (° C.) | 250 |
| Zone 6 (° C.) | 250 |
| Zone 7 (° C.) | 250 |
| Zone 8 (° C.) | 250 |
| Zone 9 (° C.) | 250 |
| Die (° C.)-right | 250 |
| Die (° C.)-middle | 250 |
| Die (° C.)-left | 250 |
| Temperature Melt (° C.) | 250 |
| Pressure after screen (bar) | 138 |
| Pressure before screen (bar) | 198 |
| Bathtub water (° C.) | 22 |
| Throughput (m/min) | 260 |
| Oven Temperature (° C.) | 100 |
| Drawn Ratio DR | 5:1 |
| Current (A) | 190 |
| Distance die-water (cm) | 7.0 |

The tapes were used to produce a raffia fabric using an Alpha 6 (six shuttle circular loom) from Starlinger. The raffia fabric had a width of 53.34 cm (60 gsm). The raffia fabric was then coated with 100 wt. % of LDPE 722 by extrusion coating process using a Starlinger Staco Tec line under the following process conditions.

TABLE 3

| Extrusion Coating Process Conditions | |
|---|---|
| Zone 1 (° C.) | 265 |
| Zone 2 (° C.) | 270 |
| Zone 3 (° C.) | 275 |
| Zone 4 (° C.) | 280 |
| Zone 5 (° C.) | 285 |
| Zone 6 (° C.) | 285 |
| Mixer (° C.) | 285 |
| Die (° C.)-right | 285 |
| Die (° C.)-middle | 285 |
| Die (° C.)-left | 285 |
| Temperature Melt (° C.) | 280 |
| Pressure after screen (bar) | 33 |
| Pressure before screen (bar) | 215 |
| Corona Treatment (kw) | 2.72 |
| Coating weight (g/m2) | 20 |
| Throughput (m/min) | 150 |

The coated heat shrinkable raffia fabric had 20 gsm of coating on each side of the heat shrinkable raffia fabric, and the heat shrinkable raffia fabric had a weight of 60 gsm. The total weight for the coated heat shrinkable raffia fabric was 100 gsm.

Comparative Film A ("Comp. A"): A monolayer film was produced on a Dr Collin blown film line. The film comprises 50 wt. % of LDPE 132i, 30 wt. % of DOWLEX™ 2045.11, and 20 wt. % of DOWLEX™ 2050B. The blown film line parameters are shown in Table 4.

TABLE 4

| Blown Film Line Parameters | |
|---|---|
| Thickness | 80 μm |
| Blow up ratio | 3.0:1 |
| Output (kg/hr) | 22.42 |
| Die diameter (mm) | 80 |
| Die gap (mm) | 1.8 |
| Die head/temp (° C.) | 235° C. |

TABLE 4-continued

| Blown Film Line Parameters | |
|---|---|
| Melt Temperature (° C.) | Extruder: 190° C.-210° C.-220° C.-235° C.-235° C.-235° C.-235° C. |
| Layflat (mm) | 377 |
| Screw Speed (rpm) | Extruder: 59 |
| Melt Pressure (bar) | Extruder: 258 bar |

Comparative Cardboards: Micro-flute corrugated cardboards at different weights, as outlined in Table 5, and which are typically used for unitization applications are used for comparative purposes.

The properties are measured and shown below in Table 5. "NM" means not measured.

TABLE 5

| Measured Properties | | | | | | |
|---|---|---|---|---|---|---|
| Analysis | Units | Inv. 1 | Comp. A | Comp. X | Comp. Y | Comp. Z |
| Weight | (g/m$^2$) | 104 | 74 | 494 | 424 | 467 |
| Dart Drop Impact-Type A @ ambient conditions | (g) | >900 | 184 | 180 | 170 | 230 |
| Dart Drop Impact-Type A @ 93% R.H., 2 wks. | (g) | >900 | NM | 155 | 179 | 208 |
| Dart Drop Impact-Type B @ ambient conditions | (g) | 450 | break | break | break | break |
| Dart Drop Impact-Type B @ 93% R.H., 2 wks. | (g) | 445 | NM | break | break | break |
| Elmendorf Tear-CD or weft direction @ ambient conditions | (g) | 6610 | 1113 | 710 | 700 | 822 |
| Elmendorf Tear-CD or weft direction @ 93% R.H., 48 hrs. | (g) | 6547 | NM | 634 | 650 | 755 |
| Elmendorf Tear-CD or weft direction @ 93% R.H., 2 wks. | (g) | NM | NM | 606 | 576 | 693 |
| Elmendorf Tear-MD or warp direction @ ambient conditions | (g) | 6481 | 336 | 669 | 732 | 657 |
| Elmendorf Tear-MD or warp direction @ 93% R.H., 48 hrs. | (g) | 6555 | NM | 604 | 700 | 574 |
| Elmendorf Tear-MD or warp direction @ 93% R.H., 2 wks. | (g) | NM | NM | 529 | 523 | 580 |
| Free Shrinkage @ 120° C.-weft direction | (%) | 20.8 | 0 | no-shrink | no-shrink | no-shrink |
| Free Shrinkage @ 120° C.-warp direction | (%) | 23.2 | 10 | no-shrink | no-shrink | no-shrink |
| Free Shrinkage @ 130° C.-weft direction | (%) | 31.1 | 10 | no-shrink | no-shrink | no-shrink |
| Free Shrinkage @ 130° C.-warp direction | (%) | 34.6 | 40 | no-shrink | no-shrink | no-shrink |
| Free Shrinkage @ 140° C.-weft direction | (%) | 48.3 | 18 | no-shrink | no-shrink | no-shrink |
| Free Shrinkage @ 140° C.-warp direction | (%) | 52.3 | 40 | no-shrink | no-shrink | no-shrink |
| Free Shrinkage @ 150° C.-weft direction | (%) | 65.6 | 20 | no-shrink | no-shrink | no-shrink |
| Free Shrinkage @ 150° C.-warp direction | (%) | 66.1 | 57.5 | no-shrink | no-shrink | no-shrink |

The results show that the inventive film (Inv. 1) has improved free shrinkage as compared to the comparative film. Also, the inventive film shows improved dart drop impact and tear properties as compared to the comparative film and the comparative corrugated cardboards.

We claim:

1. A method for shrink wrapping two or more articles, the method comprising:

providing a heat shrinkable woven raffia fabric formed from warp and weft tapes, wherein each warp and weft tape comprises 80 to 100 wt. %, based on the total wt. % of polymers present in the warp and weft tapes, of an ethylene/alpha-olefin copolymer having a density of 0.945 g/cc or greater and a melt index (I2), as determined according to ASTM D1238 (190° C., 2.16 kg), of from 0.01 to 2.0 g/10 min;

wrapping the heat shrinkable woven raffia fabric around two or more articles to form a wrapped bundle; and heating the wrapped bundle to form a shrink wrapped bundle.

2. The method of claim 1, wherein the heat shrinkable woven raffia fabric is coated with a polyolefin resin to form a coated heat shrinkable woven raffia fabric.

3. The method of claim 2, wherein the polyolefin resin comprises a low density polyethylene, a linear low density polyethylene, polypropylene, or a blend of two or more of the low density polyethylene, the linear low density polyethylene, or the polypropylene.

4. The method of claim 2, wherein the polyolefin resin comprises low density polyethylene.

5. The method of claim 1, wherein the ethylene/alpha-olefin copolymer has a density of from 0.945 to 0.960 g/cc.

6. The method of claim 1, wherein the ethylene/alpha-olefin copolymer has a melt index (I2), as determined according to ASTM D1238 (190° C., 2.16 kg) of from 0.1 to 1.5 g/10 min.

7. The method of claim 1, wherein the ethylene/alpha-olefin copolymer has a melt index ratio (I10/I2) of 7.1 to 30.0, and I10 is determined according to ASTM D1238 (190° C., 10.0 kg).

8. The method of claim 1, wherein the ethylene/alpha-olefin copolymer has a Vicat softening temperature of from 100° C. to 140° C.

9. The method of claim 1, wherein the ethylene/alpha-olefin copolymer has a molecular weight distribution (Mw/Mn) from 3.0 to 6.0, where Mw is the weight average molecular weight and Mn is the number average molecular weight.

10. The method of claim 1, wherein the wrapped bundle is heated such that the heat shrinkable woven raffia fabric reaches a temperature of from 100° C. to 165° C.

11. The method of claim 1, wherein when the wrapped bundle is heated, the heat shrinkable woven raffia fabric has a warp direction free shrinkage at 130° C. of from 5% to 90% and a weft direction free shrinkage at 130° C. of from 5% to 90%, both as measured by ASTM D2732 test method.

12. The method of claim 11, wherein the warp and weft tapes further comprise less than or equal to 30 wt. %, based on the total wt. % of polymers present in the warp and weft tapes, of one or more resins selected from the group consisting of a low density polyethylene having a density of about 0.916 g/cm$^3$ to about 0.929 g/cm$^3$, a medium density polyethylene having a density of about 0.930 g/cm$^3$ to about 0.945 g/cm$^3$, a high density polyethylene having a density of about 0.945 g/cm$^3$ to about 0.970 g/cm$^3$, a linear low density polyethylene having a density of about 0.916 g/cm$^3$ to about 0.929 g/cm$^3$, and a very low density polyethylene having a density of 0.860 g/cm$^3$ to about 0.912 g/cm$^3$.

* * * * *